United States Patent [19]

Prior

[11] 4,134,473

[45] Jan. 16, 1979

[54] PORTABLE SCAFFOLD

[76] Inventor: Herbert E. Prior, 6786 Barbara Dr., Sebastopol, Calif. 95472

[21] Appl. No.: 843,438

[22] Filed: Oct. 19, 1977

[51] Int. Cl.[2] ..... F16M 11/00

[52] U.S. Cl. ..... 182/92; 182/186; 182/226

[58] Field of Search ..... 182/186, 92, 91, 90, 182/150, 228; 280/163, 165; 248/226 D, 226 B, 226 R

[56] References Cited

U.S. PATENT DOCUMENTS

| | | | |
|---|---|---|---|
| 2,938,596 | 5/1960 | Vanyo | 182/186 |
| 3,139,951 | 7/1964 | Clayton | 182/186 |

*Primary Examiner*—Reinaldo P. Machado

*Attorney, Agent, or Firm*—Melvin R. Stidham

[57] ABSTRACT

A portable scaffolding comprising a plank with frame members supporting each end thereof. The frame members include legs of steel angles which are interconnected at their lower portions by toggle arms for collapsing, and at their upper ends by threaded members for adjusting the spacing thereof. Inwardly facing channel members on the upper ends of the legs are received over the opposite edges of the plank.

Another pair of channel members adapted to be received over the edges of the plank are also drawn together by threaded members, and depending from one of them is a step to facilitate stepping up onto the scaffold.

5 Claims, 3 Drawing Figures

PORTABLE SCAFFOLD

BACKGROUND OF THE INVENTION

Frequently, inside craftsmen such as carpenters, sheetrockers, painters, lathers and the like work on platforms which are improvised as by placing a plank between steps of facing ladders, across a pair of saw horses or the like. Such platforms are often of an unstable nature, awkward to work with and frequently dangerous. Moreover, the platforms generally must be used at the height of whatever is available to support the ends, with no means of height adjustment. Other available platforms overcome some of these disadvantages but such are expensive to acquire and rather unwieldy to handle and transport.

OBJECTS OF THE INVENTION

It is an object of this invention to provide a portable scaffold which may be assembled quickly and easily.

It is a further object of this invention to provide a scaffold which is extremely stable and which will support personnel carrying loads safely.

It is a further object of this invention to provide a portable scaffold which may be utilized at adjusted heights.

It is a further object of this invention to provide a device for mounting a scaffold easily and safely.

Other objects and advantages of this invention will become apparent from the description to follow when read in conjunction with the accompanying drawings.

BRIEF SUMMARY OF THE INVENTION

In carrying out this invention I provide a portable scaffold utilizing a plank of first grade lumber such as a standard 2 × 12 board. The plank is supported at its ends by collapsible frame members, each of which includes a pair of legs of adjustable height which are interconnected intermediate their lengths by a pair of toggle arms and near their upper ends by threaded members. Facing channel members, which are carried on the upper ends of the legs engage over the opposite edges of the plank by threading the upper ends together with a crank carried on one of them. The upper portions of the legs are in generally vertical planes to facilitate aligning with and gripping the edges of the plank, but angle away from each other, and away from the opposite frame member as they extend down toward their bases, in the nature of a three dimensional A-frame for increased stability.

A step is secured across the bottom of depending members which in turn are secured at their top ends to a channel which is received over the edge of the plank. A second channel is received over the opposite edge and threaded members secure them firmly over the plank edges. The strength of the step is enhanced by a pair of arms which are secured between the depending members and the opposite channel.

DESCRIPTION OF A PREFERRED EMBODIMENT

Figure 1:
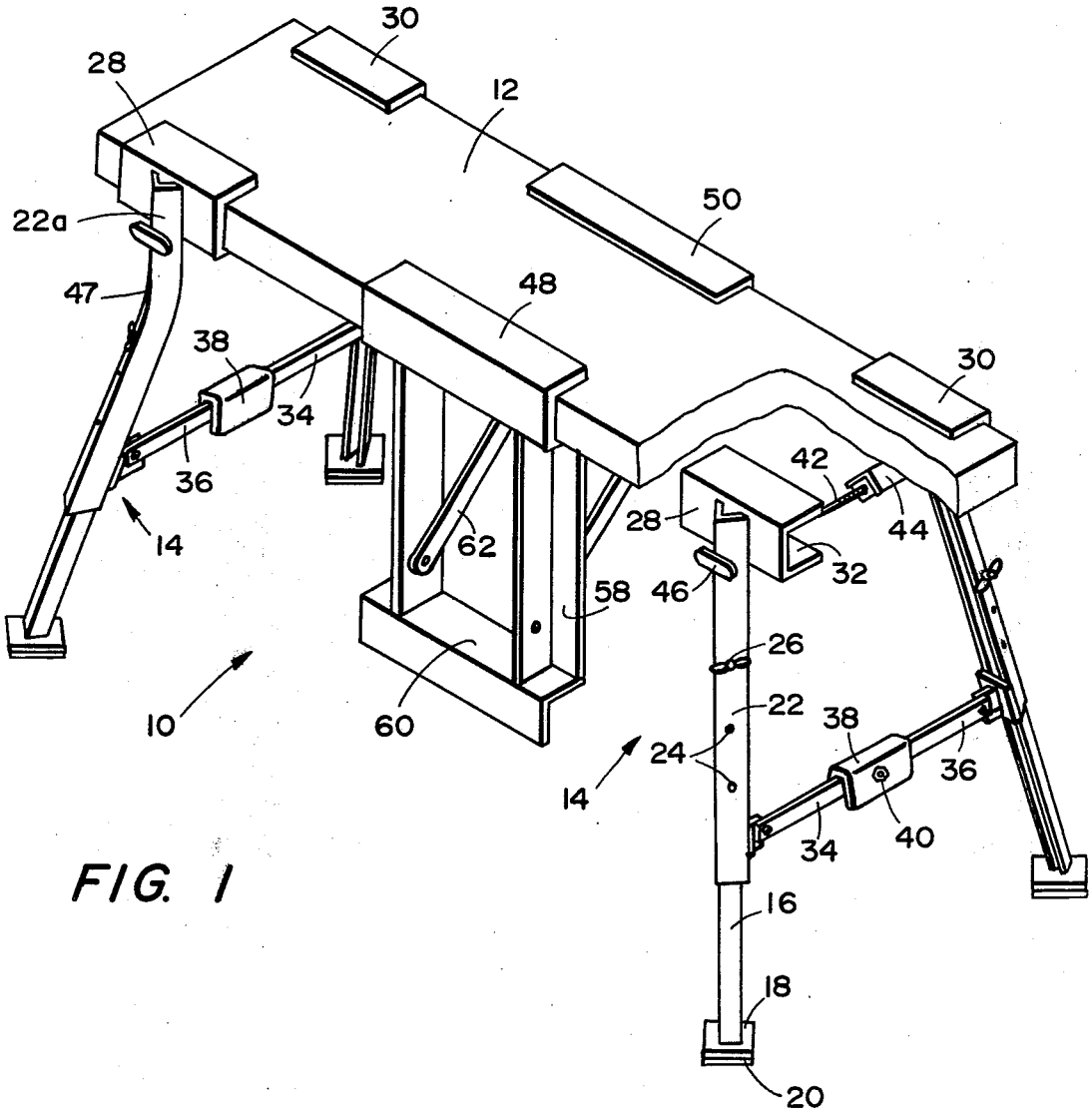
FIG. 1 is a perspective view of a portable plank scaffold of this invention with the plank partially broken away to show structure of the support members.

Referring now to FIG. 1 with greater particularity, the portable scaffold 10 of this invention includes a suitable plank 12, such as a length of 2 × 12 lumber of good quality for sturdiness, the plank being supported at both ends by collapsible frame members 14.

Each frame member comprises a pair of lower leg sections 16 supported on feet 18 of sufficient surface area so as not to indent a surface on which it is supported. Since the scaffold 10 is intended for use largely indoors by painters, sheetrockers and the like, it may be deemed as advisable to put pads 20 of rubber, carpeting material or the like on the under surface to avoid injury to the floors.

Slidably carried on the lower leg section 16 are upper leg sections 22 having a series of holes 24 which may be matched selectively with a hole in the lower leg section 16 whereby a suitable bolt 26 will secure the telescopically mounted leg sections 16 and 22 in selected lengths. Carried at the upper ends of the legs 16, 22 are facing channel members 28 and 30 which are of inner widths across their legs 32 to fit snugly over the edges of the plank 12.

The legs are interconnected intermediate their ends by a pair of toggle arms 34 and 36 with a stop member 38 carried on a central pivot 40 to lock the toggle arms in the extended positions shown. The upper ends of the legs are interconnected by male 42 and female 44 threaded members whereby the channel members 28 and 30 may be moved together over the edge of the plank 12 to hold it securely in place. Threading of the member 42, which is slidably and rotably carried on the leg 22, is facilitated by a crank or T-handle 46 which may be readily turned manually without use of tools.

As indicated, the legs 14 are inclined toward each other and toward the midpoint of the plank 12 for substantial stability. Preferably, they are bent back at 47 whereby the portion **22*a* is in a near vertical plane to facilitate engagement of the plank 12 by the channel members 28 and 30**.

Secured over the edges of the plank 12 intermediate the support frames 14 are a pair of facing channel members 48 and 50 which are interconnected by male 52 and female 54 threadedly engaged members whereby the separation of the channels 48 and 50 may be adjusted to fit them snugly and firmly over the edges of the plank, such adjustment being effected by means of a crank or T-handle 56. Depending from one channel 48 is a pair of rigid members 58 such as angles and secured between the lower ends thereof is another rigid member 60, which may also be an angle forming an intermediate step up to the plank 12. For further rigidity, a pair of arms 62 may be pivoted at 64 to the depending members 58 and secured by suitable screw means 64 to a bracket secured to the opposite channel 50. Holes 68 may be provided in the arms 62 to adjust the effective lengths thereof.

Figure 2:
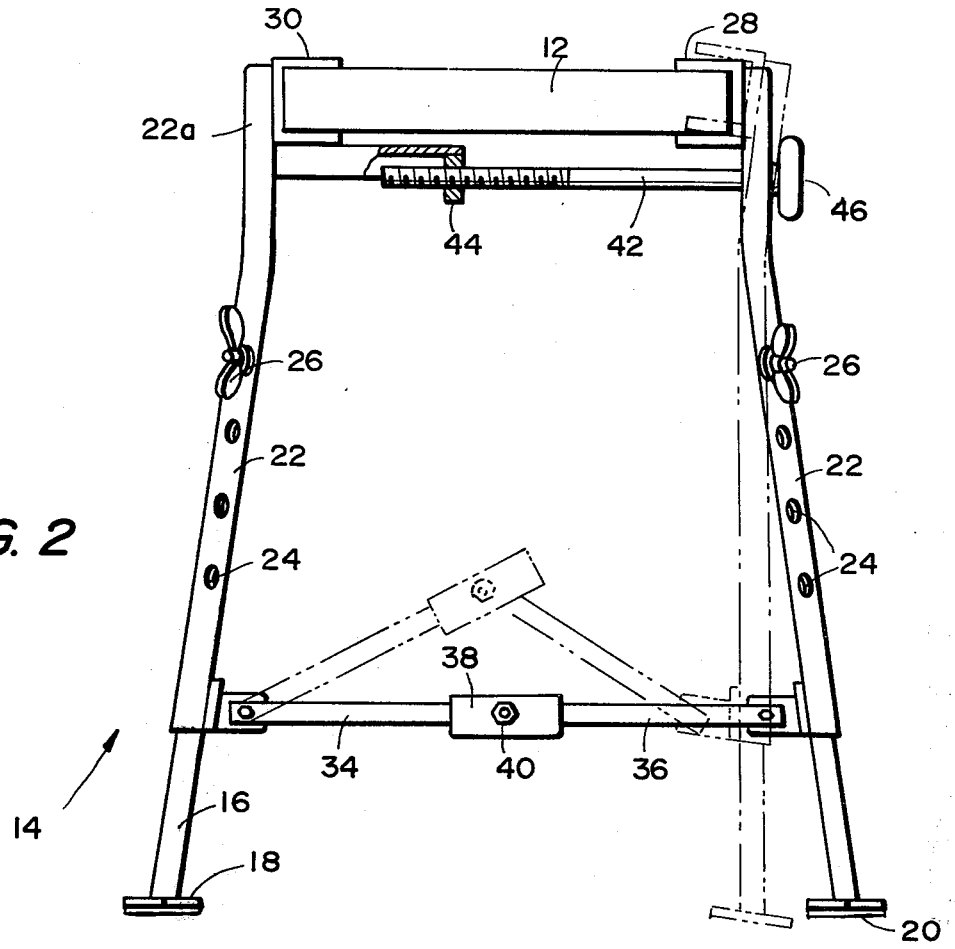
FIG. 2 is an end view of the plank.
Figure 3:
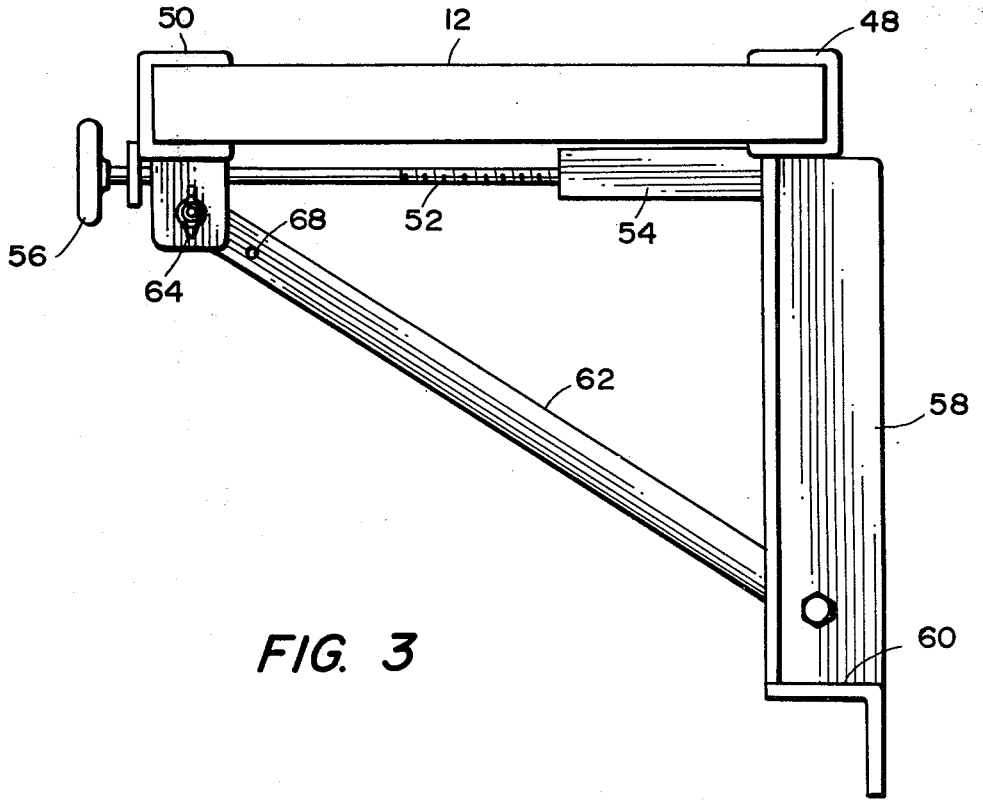
FIG. 3 is a section view of the plank showing the intermediate step.

The portable scaffold 10 when assembled as indicated in FIG. 1 provides an extremely sturdy and stable platform, providing a high degree of efficiency and safety, the safety factor being greatly enhanced by provision of the intermediate step 60 which enables one to mount the platform 12 easily even while carrying relatively heavy equipment and/or materials. As seen in phantom in FIG. 2, when the toggle arms 34 and 36 are folded upward the upper ends **22*a* of the legs pivot outward slightly about the threaded connectors 42 and 44 to retract somewhat from the edges of the plank 12. Hence, the frame members 14 may be transported merely by sliding the channels 28 and 30 from the plank and then sliding them back on at another site. When the toggle arms 34 and 36 are again extended by treading on the stop member 38 the channels 28 and 30 resume their firm grip on the edges of the plank 12**.

When the frame members 14 are disengaged from the plank 12, the sliding engagement of the male threaded connector 42 in the leg 22 enables the legs 22 to slide closer together to facilitate transporting and packing.

While this invention has been described in conjunction with a preferred embodiment thereof, it is obvious that modifications and changes therein may be made by those skilled in the art without departing from the spirit and scope of this invention, as defined by the claims appended hereto.

What is claimed as invention is:

1. A portable scaffold comprising:

a plank; and a pair of frame members supporting the ends of said plank;

each of said frame members comprising;

a pair of legs;

inwardly facing channel members carried on the upper ends of said legs;

said channel members being of an inside width to receive the edge portions of said plank;

a pair of toggle arms interconnecting said legs intermediate the lengths thereof; and complementary means each pivotally connected near the upper end of one of said legs for adjusting the spacing therebetween;

an externally threaded rod slidably extending through one of said legs;

a crank on said rod; and a complementary internally threaded member on the other of said legs;

said legs being conditioned for limited pivotal movement about their connections with said complementary means when said toggle arms are collapsed to withdraw said channel members from a position firmly gripping said plank to a retracted position wherein said plank is slidable but retained therein, including a step to said plank comprising;

a pair of rigid depending members;

a rigid step member interconnecting said depending members near the lower ends thereof;

a first channel member interconnecting the top ends of said depending member and received over an edge portion of said plank;

a second channel member facing said first channel member and received over the opposite edge of said plank; and threaded means interconnecting said channel members for adjusting the spacing therebetween.

2. The portable scaffold defined by claim 1 including a pair of arms interconnecting said depending members and said second channel.

3. A step for a plank scaffold comprising;

a pair of rigid depending members;

a rigid step member interconnecting said depending members near the lower ends thereof;

a pair of facing channel members of an inner width to receive the side edges of a plank; and threaded means interconnecting said channel means;

one of said channel members being secured between the upper ends of said depending members.

4. The step defined by claim 3 including:

a pair of arms secured between said depending members and the others of said channel members.

5. The portable scaffold defined by claim 11 including;

means for adjusting the effective lengths of said pair of arms.

* * * * *